US005382755A

United States Patent [19]

Correnti

[11] Patent Number: 5,382,755

[45] Date of Patent: Jan. 17, 1995

[54] PROTECTIVE COVER FOR ELECTRICAL WALL OUTLET

[75] Inventor: Giuseppe A. Correnti, Little Ferry, N.J.

[73] Assignee: G & G New Idea Corporation, Little Ferry, N.J.

[21] Appl. No.: 11,503

[22] Filed: Jan. 29, 1993

Related U.S. Application Data

[63] Continuation-in-part of Ser. No. 769,462, Oct. 1, 1991, abandoned.

[51] Int. Cl.[6] ..... H01R 13/44

[52] U.S. Cl. ..... 174/67; 439/147

[58] Field of Search ..... 174/67; 220/242; 439/147

[56] References Cited

U.S. PATENT DOCUMENTS 2,526,606 10/1950 Gregg ..... 174/67
4,603,932 8/1986 Heverly ..... 174/67 X
4,851,612 7/1989 Peckham ..... 174/67
5,045,640 9/1991 Riceman ..... 174/67

*Primary Examiner*—Leo P. Picard
*Assistant Examiner*—David Tone
*Attorney, Agent, or Firm*—Donald R. Heiner

[57] ABSTRACT

A protective cover for electrical wall outlets wherein a rectangular face plate is detachably mounted to the wall, over an electrical wall plug outlet, for receiving a generally rectangular shaped box-like cover having one open end, in locking engagement, to prevent access to or the touching of exposed electrical plug prongs. An upstanding flange or border is provided on all four sides of the face plate and a flange receiving cavity is formed between the face plate and flange or border at its lower and upper ends for receiving mating flanges on the upper and lower ends of the box-like cover. Flanges are also provided on the exterior of the vertical sides of the box-like cover for sliding over the vertical sides of the upstanding flange of the face plate when the two members are coupled to provide further locking engagement.

4 Claims, 4 Drawing Sheets

PROTECTIVE COVER FOR ELECTRICAL WALL OUTLET

CROSS REFERENCE TO RELATED APPLICATIONS

This application is a continuation in part of patent application Ser. No. 07/769,462 filed Oct. 1, 1991, now abandoned. Applicant has two co-pending applications; Ser. No. 07/910,522 filed Jul. 8, 1992, now U.S. Pat. No. 5,195,901; and, Ser. No. 07/906,488 filed Jun. 30, 1992, now U.S. Pat. No. 5,252,083, both of which are continuation-in-part applications and which are for the same general subject matter as the instant invention.

BACKGROUND OF INVENTION

1. Field of the Invention

The present invention generally relates to that field of technology pertaining to devices for covering an electrical wall outlet receptacle and more specifically, to a combination of a detachably mounted face plate secured to a wall and over an electrical receptacle and a generally rectangular shaped box like cover, having one open end, detachably connected to the face plate by means of flanges formed on the top and bottom edges of the box like cover, on the exterior thereof, mating with upper and lower cavities formed between the face plate and an upstanding flange or raised border which is provided on all four sides of the face plate. Disposed on the longer or vertical sides of the box like cover, on the exterior thereof and extending along a substantial portion of its length are flanges which slide over the vertical sides of the upstanding flange or border of the face plate when the two members are coupled together. This will provide further locking between the two members and will also prevent the insertion of a metal object, such as the blade of a screw driver, between the two members and making contact with the prongs of an electrical plug.

One or more openings are provided in the box like cover through which one or more electrical cords pass when an electrical appliance is plugged into the electrical outlet and the cover is in place and mating with the face plate.

Narrow slits are formed at the four corners of the box like cover to lend flexibility thereto when inserting and disengaging the cover from the face plate.

In a second embodiment of the invention only one flange receiving cavity is formed between the flange or border of the face plate and the face plate itself for mating with a flange formed on either the top or bottom edge of the box like cover, on the exterior thereof. In this embodiment slots are formed through the two vertical sides of the cover for engagement with tabs formed on the vertical sides of the raised border or flange of the face plate. With the flange of the box like cover engaging the cavity of the face plate, and the cover received over the face plate and inside the border engaging the slots formed through the two vertical sides of the cover the face plate and cover are in locking engagement.

Electrical wall outlets present several significant dangers to children and adults alike. Electrical cords tend to become worn or frayed where they enter an electrical plug; an electrical plug may become partially disengaged from an outlet thereby exposing the prongs of the plug; or, if no appliance is plugged into the electrical outlet, there is the danger of someone, especially a child, inserting a metal object into the outlet and receiving a shock.

Therefore, a need exists for a safety device which prevents against these dangers.

2. Description of the Prior Art

In applicant's co-pending application the examiner has cited the following references as examples of other devices which provide protection against the inherent dangers of electrical wall outlets; H. J. Gregg U.S. Pat. No. 2,526,606; Heverly U.S. Pat. No. 4,603,932; Peckham U.S. Pat. No. 4,851,612; and, Riceman U.S. Pat. No. 5,045,640.

The H. J. Gregg U.S. Pat. No. 2,526,606, requires a plurality of "ears" attached to the face plate with two of such "ears" having inwardly turned edges to form hook portions which cooperate with lips or beads on the two longitudinal edges of a hood portion of the device.

The Heverly U.S. Pat. No., 4,603,932, comprises three basic elements; a cover plate, a frame, and a cover box rather than the two basic elements of the instant invention. In addition, the middle element, the frame, must have a cross rib which mates with cutouts formed in the side faces of the third member which is the cover box. Still further, the middle element, the frame, has a plurality of cutouts which mate with tabs formed on the cover box. Thus, it is readily apparent that the instant invention has fewer parts and is of simpler construction. The instant invention essentially eliminates the frame member.

The Peckham U.S. Pat. No. 4,851,612 discloses a face plate having a trio of notches formed in its two longitudinal edges for receiving a series of "full size" tabs formed on one sidewall of an enclosure housing and a pair of smaller tapered alignment tabs formed on a second sidewall of such enclosure housing. In addition this second sidewall has one main full size tab. This series of different tabs and alignment slots is more complicated than the arrangement shown by the instant invention.

The Riceman U.S. Pat. No. 5,045,640 has a cover which is hinged to the receiving or face plate and a plurality of locking projections and locking hooks for engaging receiving holes formed through a raised flange formed with and extending outwardly of the face plate for securing the cover to the face plate. The cover of the instant invention is not hingedly connected to the face plate nor are there holes formed through a raised flange of the face plate of the instant invention.

SUMMARY OF THE INVENTION

According to the present invention a face plate having one or more openings there through for receiving a standard electrical plug is attached by any well known means, such as a screw or other fastening device, to a wall mounted electrical plug receptacle.

The face plate has an upstanding flange or raised border on all four sides extending outwardly of and approximately perpendicular to the planar face of the face plate. A flange receiving cavity is formed between the planar face of the face plate and the upstanding flange or raised border at both of the shorter horizontal ends of the face plate and extending the entire width of the face plate for receiving cooperating flanges formed on a protective cover of the invention.

The protective cover is a generally rectangular shaped box like cover having one open end for engaging the face plate. Formed on the exterior of the horizontal ends of the protective cover are flanges which extend the entire length thereof for engaging the cavities formed between the face plate and the upstanding flange or raised border.

With the cover positioned over the face plate the flanges of the protective cover engage the cavities of the face plate thus holding the face plate and cover in locking engagement. Flexibility is lent to the cover by means of narrow slits formed at its four corners.

Flanges may also be provided on the exterior of the vertical sides of the protective cover for sliding over the vertical sides of the upstanding flange or border of the face plate for further sealing and locking of the two members when the two members are coupled together. These flanges extend substantially the entire length of the vertical sides of the cover and will further prevent the insertion of a flat metal object, such as the blade of a screw driver, between the cover and face plate and making contact with the prongs of an electrical plug.

The cover is further provided with openings to allow passage of electrical cords connected at one end to an electrical plug and at the other end to an electrical appliance.

In a second embodiment of the invention only one cavity is formed between the planar face of the face plate and the flange or border and tabs are formed on the interior vertical flange or border for mating with cooperating slots formed through the two vertical sides of the protective cover. In this embodiment the exterior flanges on the vertical sides of the protective cover are eliminated.

It should be obvious that in this second embodiment there can be two cavities such as in the preferred embodiment and that the cover can be rotated 180°, rod to bottom, for mating the flange of the cover with the cavity or cavities of the face plate.

In this embodiment the face plate and protective cover are held in locking and protective engagement by means of the flange or flanges of the protective cover engaging the cavity or cavities of the face plate and the tabs of the face plate engaging the slots formed through the two vertical sides of the protective cover.

It should be further obvious that there may be one or more tabs and therefore one or more slots for mating with each other in this embodiment.

It is therefore an object of the present invention to provide a protective cover for an electrical wall outlet.

It is another object of the invention to provide an improved protective cover for an electrical wall outlet having a protective cover engaging a face plate which in turn is mounted on an electrical plug receptacle.

It is a further object of the invention to provide an improved protective cover for an electrical wall outlet wherein a face plate has an upstanding flange or raised border and upper and lower cavities formed between the face plate and flange or raised border for receiving flanges formed on the top and bottom edges of a box like cover.

It is yet another object of the invention to provide an improved protective cover for an electrical wall outlet wherein a box like cover has flanges disposed on the longer or vertical sides thereof, and extending a substantial portion thereof, for engagement with the vertical sides of a face plate.

It is still a further object of the invention to provide an improved protective cover for an electrical wall outlet wherein a face plate has an upstanding flange or border and wherein the vertical sides of the border have tabs formed on the interior thereof for mating with corresponding slots formed through the vertical sides of a cover.

These and other objects, features and advantages of the invention shall become apparent from the following detailed description of a preferred embodiment thereof when taken in conjunction with the drawings wherein like reference characters refer to corresponding parts in the several views.

DETAILED DESCRIPTION OF THE PREFERRED EMBODIMENT

Figure 1:
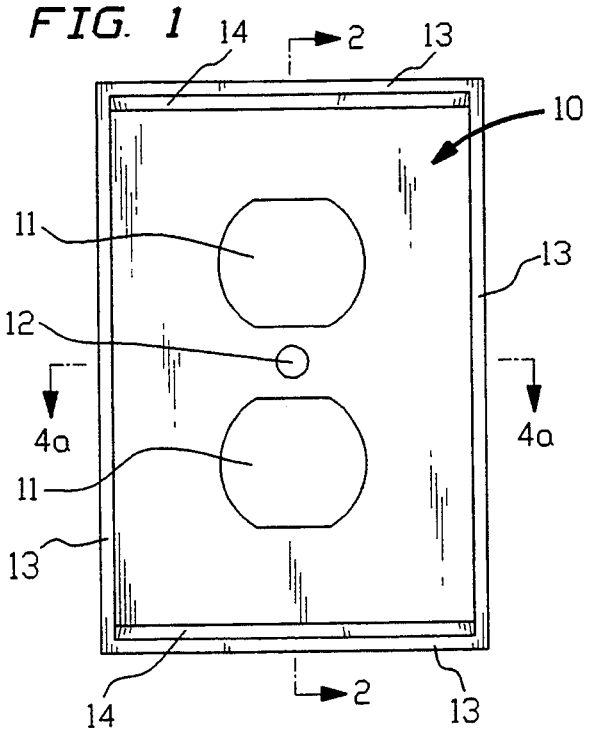
FIG. 1 is a front view of the face plate of the invention showing the electrical plug outlets and flange or raised border on all four sides and an opening for receiving a fastener for attaching the face plate to an electrical wall plug receptacle not shown.
Figure 2:
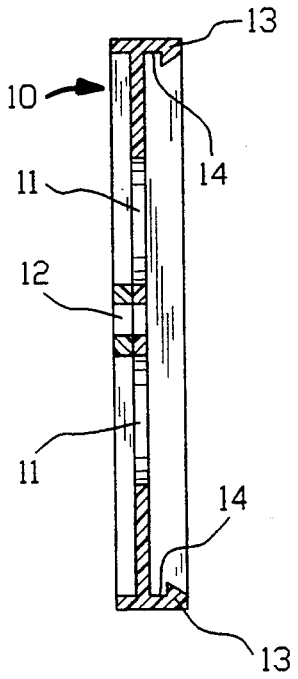
FIG. 2 is a sectional view of the face plate taken along line 2—2 of FIG. 1.

An electrical wall plug outlet enclosure and safety device according to a preferred embodiment of the invention will now be described with initial reference to FIGS. 1–6 of the drawings and then an alternate embodiment of the invention will be described with reference to FIGS. 7–12 of the drawings.

A face plate 10 for mounting on to an electrical wall plug outlet, not shown, has electrical plug receiving openings 11 formed therethrough and a hole 12 for a fastener, such as a screw, is located at the approximate mid-point of such face plate for securing it to the electrical wall plug outlet. A border or upstanding flange 13 is integrally formed on all four sides of the face plate and is approximately perpendicular to the planar surface of the face plate. A cavity 14 is formed between the planar surface of the face plate and the flange 13 at the upper and lower or horizontal sides of said face plate 10 for receiving flanges as will be more fully described below.

A box-like cover 15 having one open end 16 has two horizontal sides 17 and two vertical sides 18 and a top 19 opposite the said open end 16 for covering the electrical wall plug outlet when the cover is in place over the face plate. Further, Narrow slits 20 are formed at each of the four corners of the box-like cover which make the cover more flexible. When the sides or ends of the cover are squeezed with fingers of a hand the sides or ends squeezed will flex inwardly which will allow the cover to be more easily engaged into or disengaged from the border or upstanding flange.

Formed integral with said box-like cover, on the exterior horizontal sides 17 thereof, and adjacent to said open end 16, are flanges 21 approximately perpendicular to the flat surfaces of the horizontal sides 17 of box-like cover 15. These flanges 21 extend the width of the box-like cover for mating with or engaging the cavities 14 formed between the planar surface of the face plate and the upstanding flange at the two horizontal sides thereof.

Second flanges 22 are formed integral with and on the exterior of the two vertical sides 18 of the box like cover and along a substantial portion of the vertical sides which second flanges slide over the vertical sides of said border or upstanding flange when the face plate and box like cover are in locking engagement thereby providing further locking engagement between these two members and further preventing the insertion of an object, such as the blade of a screw driver, between the two members and making contact with the prongs of an electrical plug.

Figure 3:
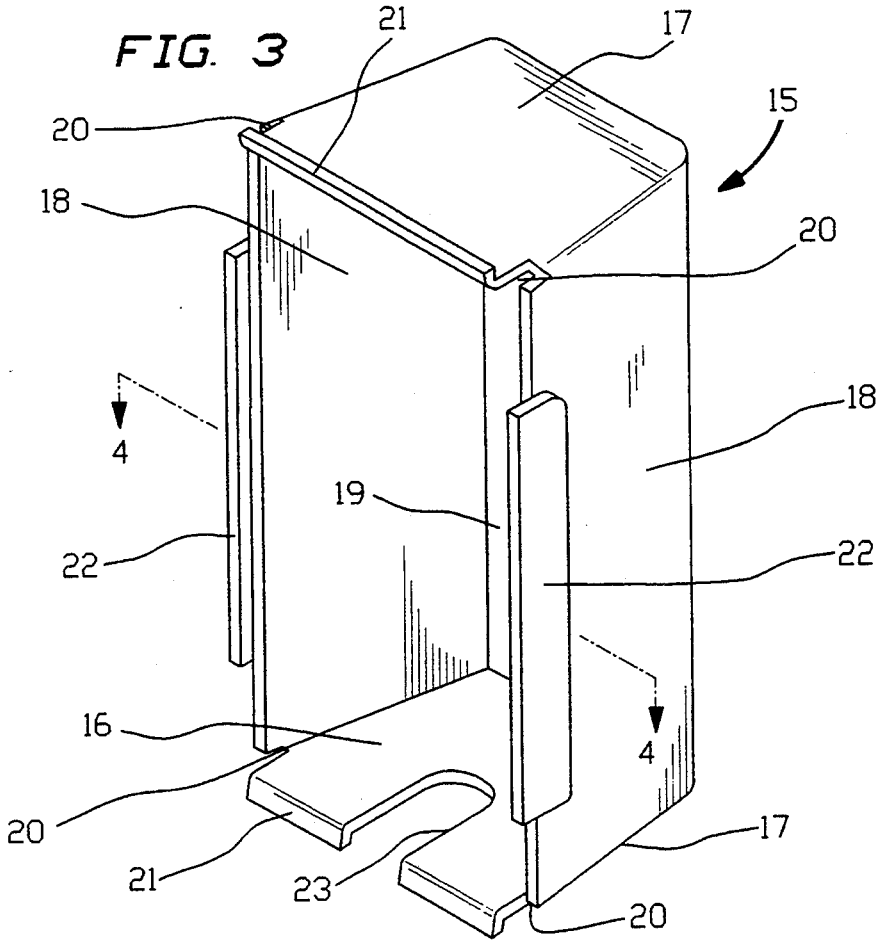
FIG. 3 is a perspective view of the protective cover of the invention showing the four corner slots, exterior flanges and electrical cord receiving opening.
Figure 4:
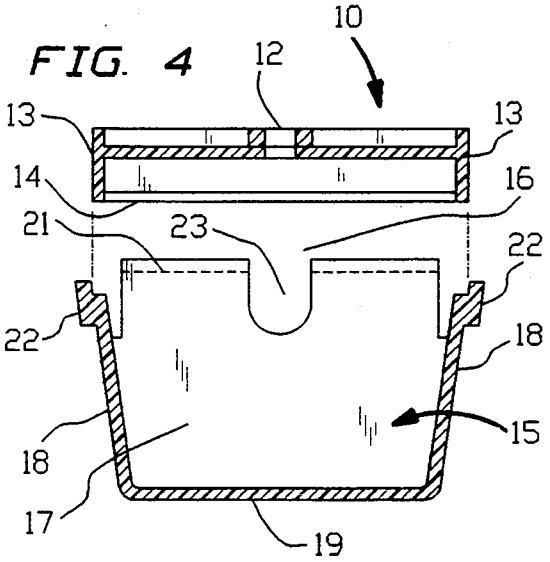
FIG. 4 is an exploded sectional view taken on line 4—4 of FIG. 3, and on line 4A—4A of FIG. 1.
Figure 6:
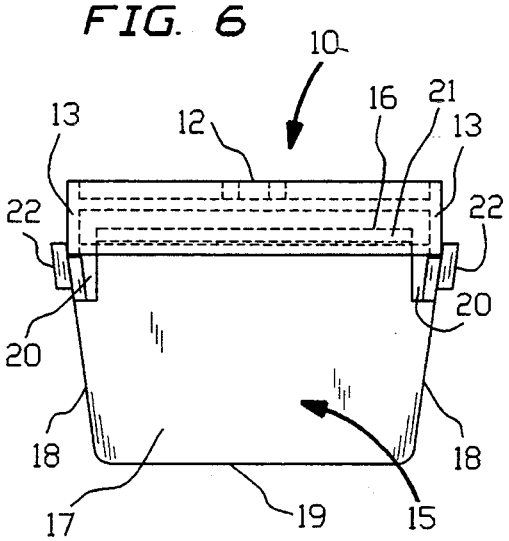
FIG. 6 is an end view showing the face plate and protective cover coupled together and showing the flange or raised border in dotted lines.

An opening 23 is formed through the box-like cover as shown in FIGS. 3 and 4 through which one or more electrical cords pass when an electrical appliance is plugged into the electrical wall outlet and the box like cover is in locking engagement with the face plate.

Figure 5:
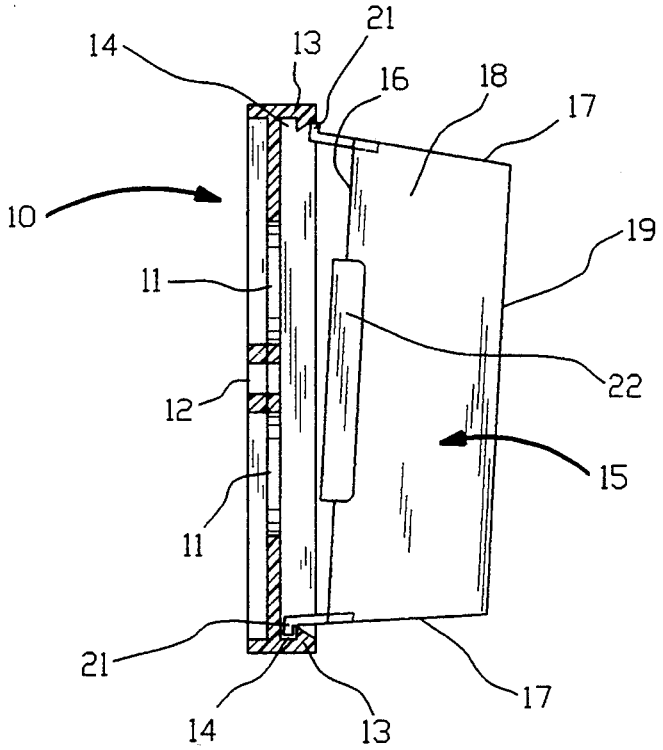
FIG. 5 is a view of the face plate as shown in FIG. 2 showing the coupling with the protective cover FIG. 3.

In operation, and as best seen in FIG. 5, one of the flanges 21 is inserted into one of the cavities 14 by slightly tilting the box-like cover and the other end of the cover is then simply pressed against the border or upstanding flange at the other horizontal end of the face plate and it will slide into and engage the other cavity thereby holding the face plate and box-like cover in locking engagement. The second flanges on the vertical sides of the box-like cover will slide over the vertical sides of the border or upstanding flange of the face plate thereby providing further locking engagement between the two members.

When it is desired to disengage the box-like cover from the face plate the ends of the cover are squeezed inwardly with the fingers of the hand thereby disengaging the flanges from the cavities. Flexibility of the cover is enhanced by the four corner slits.

A second embodiment of the invention will now be described with reference to FIGS. 7–12.

In this embodiment one cavity 14 is formed between the planar surface of the face plate 10 and the upstanding flange 13 at either end and flanges 21 are formed on the exterior horizontal ends of the box-like cover as in the preferred embodiment. The cover can therefore be rotated 180° for inserting one of its flanges into the cavity of the face plate.

Figure 7:
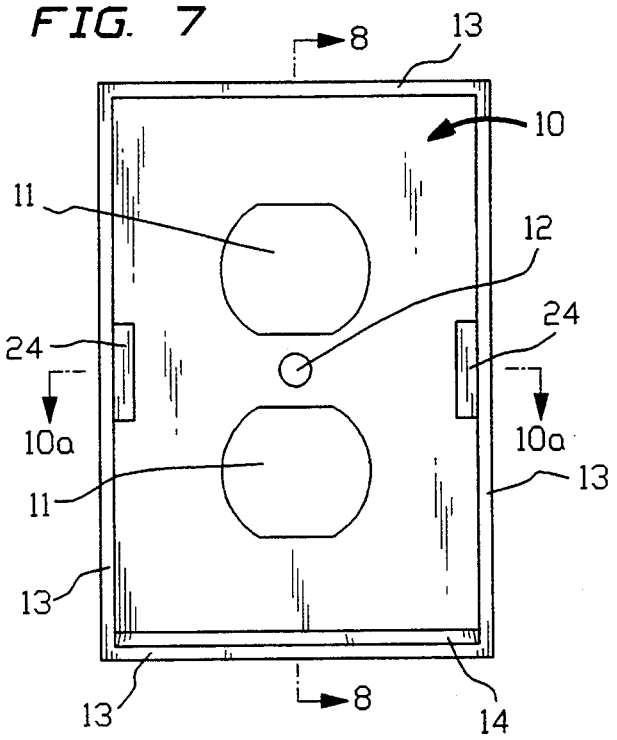
FIG. 7 is a front view of the face plate of the second embodiment of the invention showing the electrical plug outlets and flange or raised border on all four sides and opening for receiving a fastener for attaching the face plate to an electrical wall plug receptacle not shown and further showing the tabs formed on the vertical sides of the border. This is similar to FIG. 1.
Figure 8:
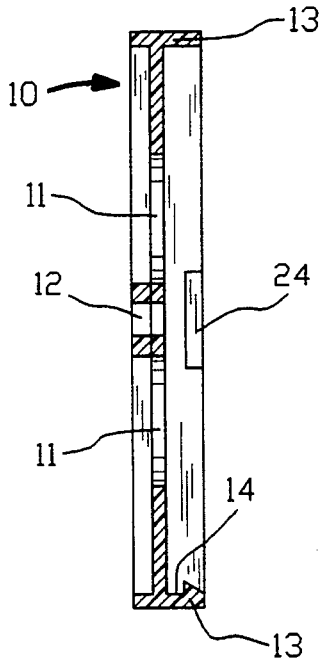
FIG. 8 is a sectional view of the face plate taken along line 8—8 of FIG. 7 and is similar to FIG. 2.
Figure 9:
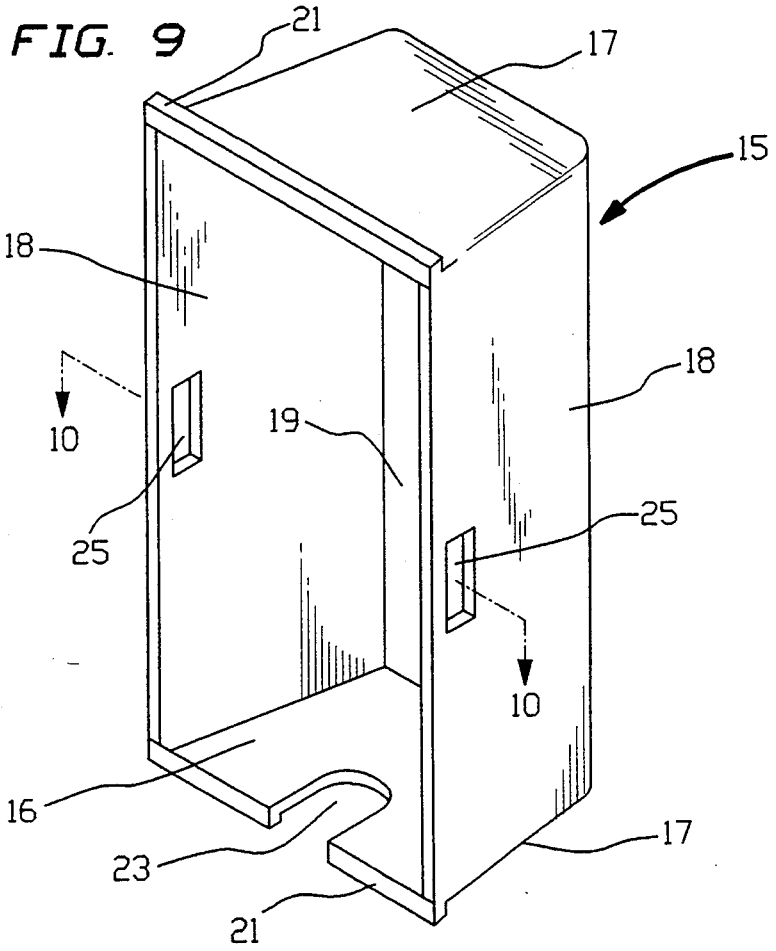
FIG. 9 is similar to FIG. 3 showing a perspective view of the protective cover of the second embodiment of the invention.
Figure 10:
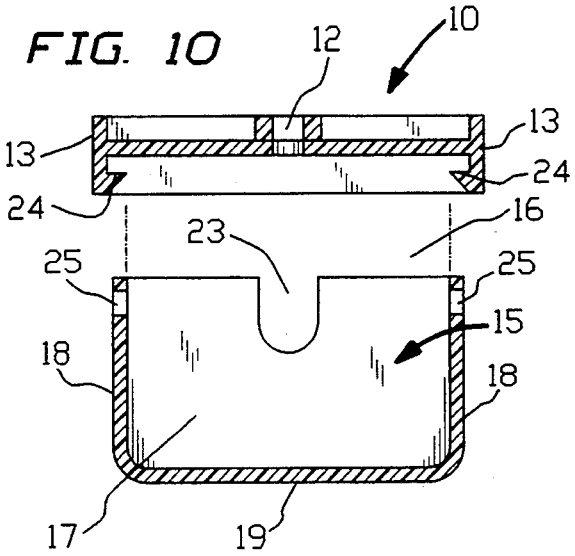
FIG. 10 is an exploded sectional view taken on line 10—10 of FIG. 9, and line 10A—10A of FIG. 7.
Figure 12:
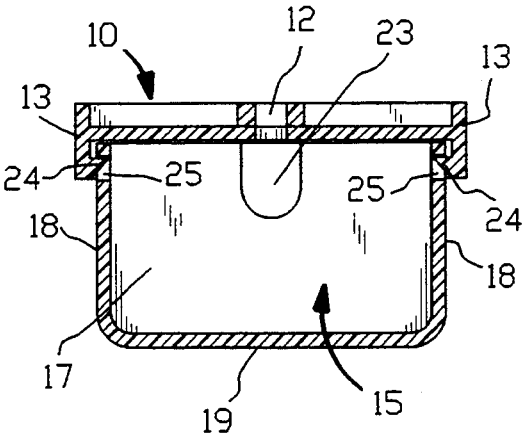
FIG. 12 is a view similar to FIG. 10 but showing the face plate and protective cover coupled together in a sectional end view.
Figure 11:
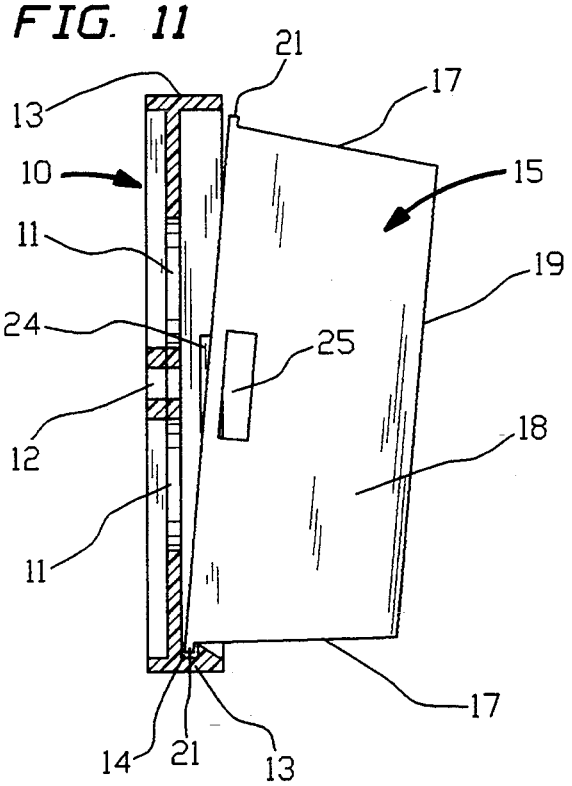
FIG. 11 is a view of the face plate shown in FIG. 8 showing the coupling with the protective cover of FIG. 9.

Tabs 24 are formed on each of the two vertical sides of the upstanding flange 13, interiorally thereof, and adjacent to the planar surface of the face plate as clearly shown in FIG. 7. One or more tabs 24 may be formed on each vertical side of upstanding flange 13.

Tabs 24 engage corresponding slots 25 formed through the two vertical sides of the box-like cover thereby holding the box-like cover in locking engagement with the face plate when the cover is positioned over the face plate.

In this embodiment, the flange on the horizontal end of the box-like cover is inserted into the cavity of the face plate, the vertical sides of the box-like cover are flexed inwardly with the fingers of the hand, the box-like cover is pushed inwardly toward the face plate, the fingers are released, and the tabs will engage the slots of the cover forming a locking engagement.

Though the invention has been described and illustrated with reference to a preferred and an alternate embodiment thereof, those skilled in the art will appreciate that various changes and modifications in shape, size, composition and arrangement of parts may be resorted to without departing from the spirit of the invention or scope of the subjoined claims.

What is claimed is:

1. A protective cover for electrical wall outlets comprising:

(a) a face plate having four sides and at least one electrical plug receiving opening, said face plate being adapted to be detachably mounted to an electrical wall plug outlet, for detachably receiving a box-like cover;

(b) an upstanding flange formed on the four sides of said face plate;

(c) cavities formed between said face plate and said upstanding flange at the two horizontal sides of said face plate;

(d) a box-like cover having one open end for positioning over said face plate; and (e) said box-like cover having flanges formed on the exterior horizontal sides thereof adjacent said open end, said flanges extending the width of said box-like cover whereby when said box-like cover is positioned over said face plate said flanges engage said cavities thereby holding said box-like cover in locking engagement with said face plate and wherein slits are formed at the four corners of said box-like cover to provide flexability to said box-like cover when said box-like cover is engaging or becoming disengaged from said face plate.

2. A protective cover for electrical wall outlets comprising:

(a) a face plate having four sides and at least one electrical plug receiving opening, said face plate being adapted to be detachably mounted to an electrical wall plug outlet, for detachably receiving a box-like cover;

(b) an upstanding flange formed on the four sides of said face plate;

(c) cavities formed between said face plate and said upstanding flange at the two horizontal sides of said face plate;

(d) a box-like cover having one open end for positioning over said face plate;

(e) said box-like cover having flanges formed on the exterior horizontal sides thereof adjacent said open end, said flanges extending the width of said box-like cover whereby when said box-like cover is positioned over said face plate said flanges engage said cavities thereby holding said box-like cover in locking engagement with said face plate; and (f) second flanges formed on the exterior of the two vertical sides of said box-like cover and along a substantial portion of the length of said vertical sides which slide over the vertical sides of said upstanding flange when the said face plate and said box-like cover are in locking engagement thereby providing further locking engagement between the two members and preventing the insertion of an object between the two members.

3. A protective cover for electrical wall outlets comprising:

(a) a face plate having four sides and at least one electrical plug receiving opening, said face plate being adapted to be detachably mounted to an electrical wall plug outlet, for detachably receiving a box-like cover;

(b) an upstanding flange formed on the four sides of said face plate;

(c) at least one cavity formed between said face plate and said upstanding flange at one of the two horizontal sides of said face plate;

(d) a box-like cover having one open end for positioning over said face plate;

(e) said box-like cover having flanges formed on the exterior horizontal ends thereof adjacent said open end, whereby when said box-like cover is positioned over said face plate at least one of said flanges engages said at least one cavity to aid in holding said box-like cover in locking engagement with said face plate; and (f) at least one tab formed on each of the two vertical sides of said upstanding flange for engaging slots formed through the two vertical sides of said box-like cover thereby holding said box-like cover in locking engagement with said face plate.

4. A device as claimed in claim 3 wherein at least one opening is formed through said box-like cover through which one or more electrical cords pass when an electrical appliance is plugged into said electrical wall outlets and said box-like cover is in locking engagement with said face plate.

* * * * *